United States Patent [19]

Pacht

[11] 3,987,963

[45] Oct. 26, 1976

[54] FLUID DELIVERY SYSTEM

[75] Inventor: Amos Pacht, Houston, Tex.

[73] Assignee: Partek Corporation of Houston, Houston, Tex.

[22] Filed: June 27, 1975

[21] Appl. No.: 591,100

[52] U.S. Cl. ..... 239/124; 239/197; 239/240; 239/252; 134/167 C; 118/306

[51] Int. Cl.[2] ..... B05B 3/02; B05B 3/18; B08B 3/02; B08B 9/04

[58] Field of Search .... 118/306, 317, 323, DIG. 10, 118/313, 315; 239/227, 240, 242, 251, 252, 255, 256, 259, 263, 197, 198, 199, 588, 124, 126; 134/24, 152, 166 C, 167 C

[56] References Cited

UNITED STATES PATENTS

| | | | |
|---|---|---|---|
| 2,518,990 | 8/1950 | Keener | 239/197 X |
| 2,520,397 | 8/1950 | Green | 118/306 |
| 2,792,807 | 5/1957 | Cummings | 118/306 X |
| 3,056,155 | 10/1962 | Harmes | 118/DIG. 10 |
| 3,109,262 | 11/1963 | Weaver et al. | 239/240 X |
| 3,120,346 | 2/1964 | Willhoite | 118/306 X |
| 3,122,786 | 3/1964 | Huisman | 118/DIG. 10 |
| 3,135,629 | 6/1964 | McLean | 118/DIG. 10 |
| 3,516,385 | 6/1970 | Walling | 118/317 X |
| 3,765,607 | 10/1973 | Pacht | 239/124 |
| 3,797,745 | 3/1974 | Haus | 118/317 X |

FOREIGN PATENTS OR APPLICATIONS

| | | | |
|---|---|---|---|
| 969,697 | 9/1964 | United Kingdom | 118/306 |
| 249,610 | 3/1926 | United Kingdom | 118/DIG. 10 |

*Primary Examiner*—Robert S. Ward, Jr.
*Attorney, Agent, or Firm*—Hubbard, Thurman, Turner & Tucker

[57] ABSTRACT

A high pressure fluid delivery system is disclosed in which a source of fluid is connected by a rotating mechanism to an elongated lance or a cleaning head each of which includes one or more outlet nozzles for providing a cleaning jet of fluid. The lance or spray head is rotated by the rotating mechanism to provide substantially complete cleaning of the inside of a tubular member. The rotating mechanism may also be connected between a hose reel and the fluid source to permit the payout of a hose from the reel to the fluid delivery apparatus of the system.

15 Claims, 9 Drawing Figures

FLUID DELIVERY SYSTEM

This invention relates to a high pressure fluid delivery system and in one of its aspects to such a system for cleaning the inside wall of a tubular member. In another aspect of the invention, it relates to such a system in which the high pressure fluid is conducted from a stationary fluid source to one or more outlet nozzles connected either to an elongated rotating lance or a rotating cleaning head.

In the prior art, fluid systems are provided in which a high pressure stream of water, i.e., at pressures of 6,000 – 10,000 p.s.i. or more, are used for many cleaning applications. In these systems, one or more hand-held valve assemblies or guns are provided, and are connected by a hose to a common outlet of a pump. The guns generally include a housing having a valve therein, a barrel extension for directing the high pressure stream of water through a nozzle to the object to be cleaned, a handle or trigger mechanism for operating the valve, and a relatively unrestricted pressure relief or "dump" outlet for relieving pressure in the assembly when flow through the high pressure nozzle outlet is interrupted by operation of the valve.

There are a number of applications where it is desirable to rotate the nozzle or to rotate a cleaning head including a plurality of nozzles during the cleaning operation. For example, an elongated lance having an outlet nozzle at one end for providing a jet of cleaning fluid may be connected to the barrel extension of the gun for insertion into a tubular member, such as a heat exchange tube in a heat exchange bundle, for cleaning and removing encrustations from the interior of the tube. In order to insure cleaning of the entire interior surface of the tube, it is necessary to either provide a plurality of openings in the nozzle, and about its circumference, such as illustrated in U.S. Pat. No. 2,735,794, or to rotate the nozzle as it moves through the tube.

The latter operation is preferred because it insures complete and thorough cleaning, and a number of prior art devices have been provided for accomplishing this operation with relatively low fluid pressures. However, none of these devices are suitable for use in the higher fluid pressure applications referred to where rapid wear and leakage problems are magnified nor are they readily adaptable for a variety of different applications wherein a stationary fluid source is operatively connected to a rotating lance or cleaning head.

It is thus the primary object of this invention to provide a high pressure fluid cleaning system which includes a rotating mechanism for conducting fluid at relatively high pressures in excess of 10,000 pounds per square inch from a stationary source to an elongated lance or spray head while providing for rotation thereof.

Also, in the applications referred to, particularly where a hand held dump gun is employed, it is important that any addition to the gun be relatively compact and light. Further, because of the high fluid pressures involved, thrust and torque become significant factors and it is necessary to design the rotating mechanism to lessen problems associated with high torque and thrust, as well as leakage. A further object of this invention is to provide a rotating mechanism for high pressure applications which is so designed so that it is not subject to constant maintenance and repair, or leakage problems associated with attempts to use prior art devices in the high fluid pressure environment for which the present invention is designed.

These objects are accomplished by this invention by providing a fluid delivery system including a rotating mechanism in which surface areas that are exposed to high fluid pressures in a direction to cause increase in wear or operating torque are kept to a minimum, and wherein torque is kept relatively low by keeping the coefficient of friction during rotation at a relatively low figure. Also, an effective seal of low coefficient of friction is provided to minimize leakage of fluid at the relatively high pressure employed.

An important feature of this invention is that a number of different embodiments of the high fluid pressure cleaning system of this invention are provided for cleaning the inside of different size tubular members which utilize the same design of rotating mechanism. For example, relatively small tubes in heat exchange tube bundles may be cleaned by rotating an elongated lance, having a spray nozzle on one end, inside the tube as the lance is moved along the length of the tube. Also, where a large diameter tubular member is to be cleaned, such as paper mill suction rolls, a rotating cleaning head including a plurality of nozzles may be mounted on a suitable carriage and propelled, either by an external power medium or by suitably directing the fluid jets from the nozzles, along the length of the paper mill suction rolls. In both examples, the use of the rotating mechanism of the present invention provides improved cleaning of the tubular member because;

i. it permits safe and effective use of a ralatively high pressure fluid, i.e., 6,000 to 10,000 pounds per square inch and greater,
ii. the spray nozzle may be placed close to the surface to be cleaned, and
iii. the fluid stream may be directed to provide the most effective cleaning.

Also, the rotating mechanism of this invention may be employed for connecting a high pressure hose on a rotating drum to a stationary source of water, and the hose may, in turn, be fed out from the drum to supply fluid to a dump gun or dump valve. In this case, the high pressure fluid delivery system may also include a second rotating mechanism connected to a rotating lance, or to the paper mill suction roll cleaning apparatus described. Of course, systems for uses other than the two examples given which require the conduction of relatively high pressure fluid to a rotating cleaning apparatus are contemplated by, and are within the scope of, this invention.

In the drawings, wherein like reference numerals are used throughout to designate like parts, and wherein preferred embodiments of this invention are illustrated;

Figure 1:
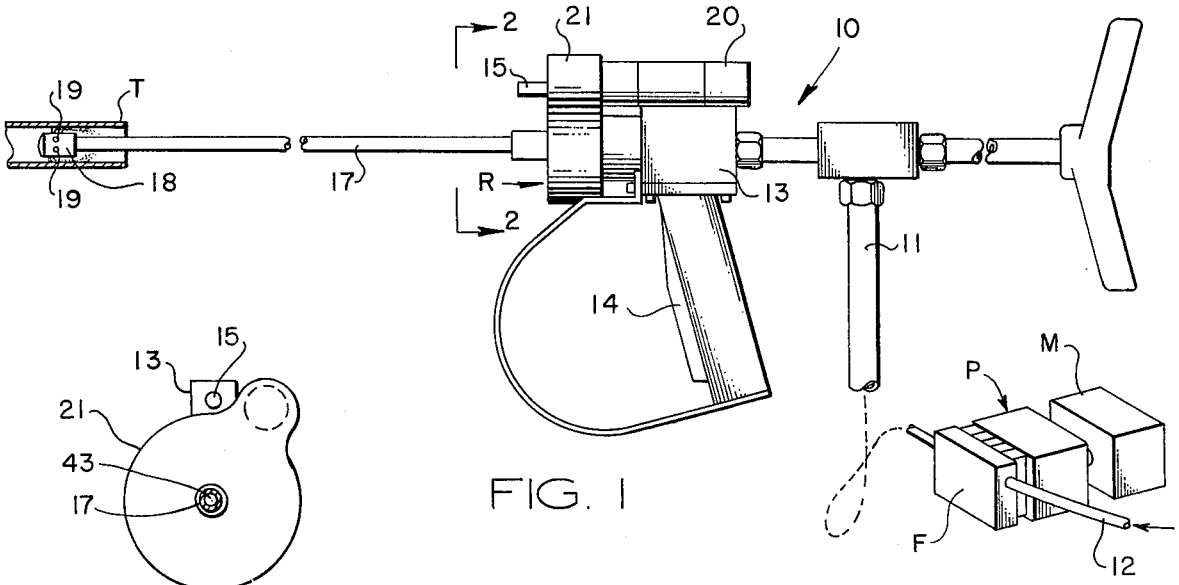
FIG. 1 is a side in elevation of one form of the high pressure fluid delivery system of this invention in which an elongated lance having a nozzle thereon is rotatably connected to a dump gun.
Figure 2:
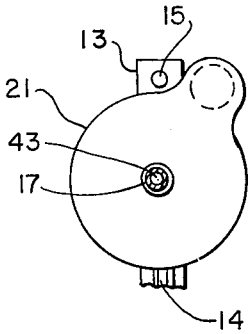
FIG. 2 is a front view partially in section and partly in elevation taken at 2 — 2 in FIG. 1.

Referring now to the drawings, in FIG. 1, a fluid delivery system of this invention is disclosed as including a dump gun generally indicated by the numeral 10 connected through a conduit or hose 11 to the outlet of a high pressure pump generally represented by the letter P. Pump P includes a prime mover or motor M and a fluid end F that is connected through an inlet conduit or hose 12 to a source of fluid (not shown), such as water. Pump P in the embodiment illustrated is capable of providing fluid pressures in excess of 10,000 p.s.i. for cleaning applications.

Figure 3:
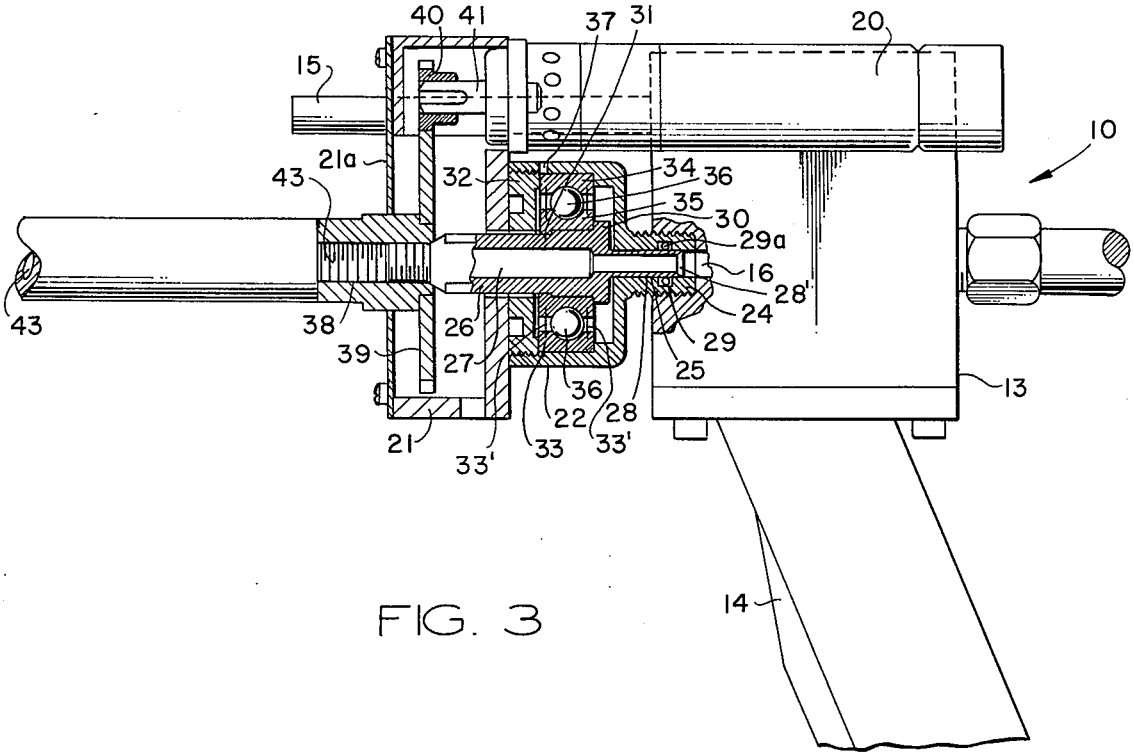
FIG. 3 is an enlarged view, partly in section, of the rotating mechanism of the FIG. 1 embodiment.

Dump gun 10, which may be similar to the dump gun illustrated in U.S. Pat. No. 3,765,607 assigned to the assignee of this invention, includes a valve mechanism (not shown) in a housing 13. The valve mechanism is operated by a trigger 14 to divert the flow of water from a low pressure or dump outlet 15 as shown in FIG. 1, to a high pressure outlet 16 as shown in FIG. 3. In the embodiment illustrated, outlet 16 is normally connected to a barrel extension having a nozzle on the end thereof as illustrated in the referenced patent, however, in accordance with this invention, a rotating mechanism generally represented by the letter R is connected to outlet 16 and in turn connected to one end of an elongated lance 17 which has a spray nozzle 18 at its other end. Thus, in accordance with this invention, while gun 10 may be held stationary by the operator, lance 17 may be rotated and provide the high pressure spray required to clean the inside of a tube T which may be one of the plurality of tubes provided to make up a heat exchange bundle, or any other tube the inside of which is to be cleaned.

U.S. Pat. No. 3,765,607 may be referred to for the details of the valve mechanism of dump gun 10, and its operation, however, it is to be understood that the system of the present invention may be employed with other dump valves or dump guns of different designs.

As illustrated in FIG. 1, rotating mechanism R includes an air motor 20 mounted on a gear housing 21 which houses a gear mechanism, and a rotator 22, which is also mounted on gear housing 21 for rotating lance 17 while high pressure fluid is conducted through the lance. The details of the gear mechanism in housing 21 and rotator 22 are shown in FIG. 3. Rotator 22 includes a threaded inlet coupling 24 having a central bore 25 therethrough, and coupling 24 is connected into the high pressure outlet of dump gun 10. Rotator 22 also includes a center rotatable shaft 26 which includes a center passageway 27 through it. Shaft 26 includes an elongated neck portion 28 of relatively small diameter which extends into the outer portion of bore 25 and beyond a groove 29 in bore 25. Neck portion 28 is sealed about its periphery, and between its outer periphery and the inner wall of coupling 24, by a high pressure, low friction seal **29*a* (preferably made of Teflon) disposed in groove 29, which permits the rotation of neck portion 28 in bore 25 while preventing the passage of fluid along the outside surface of neck portion 28. Also, neck portion 28 fits sufficiently loose in bore 25** to permit its rotation without substantial friction.

It is preferred that neck portion 28 be of a relatively small diameter so that its external surface area is not so large as to provide substantial friction between it and the inside wall of bore 25, or so large as to provide relatively large rotational moments. Also, it is preferred that the end 28' of neck portion 28 exposed to high pressure fluid be relatively small in surface area to reduce the force urging shaft 26 out of bore 25 because of the high fluid pressure.

Rotatable shaft 26 also includes a radially extending flange 30 at the end of neck portion 28, and an enlarged diameter inner portion 31 extending from flange 30 through a closure plug 32 for rotator 22 and into gear housing 21. As illustrated in FIG. 3, a ball bearing assembly 33 is mounted in rotator 22, and about portion 31 of shaft 26 between flange 30 of the shaft and closure plug 32. Bearing assembly 33 includes an outer, circular, stationary portions 34, an inner, circular, rotatable portion 35, and a plurality of ball bearings 26 disposed between these portions to permit relative rotation thereof. As illustrated in FIG. 3, rotatable portion 35 is abutted only against flange 30 of the rotatable shaft and is spaced with sufficient clearance from plug 32 to permit its rotation without interference. However, stationary portion 34 of ball bearing assembly 33 is abutted tightly between rotator 22 and closure plug 32 to hold the ball bearing assembly in place.

It is also preferred that ball bearing assembly 33 by a single row radial bearing which is self lubricated and includes an internal seal 33' on both sides of balls 36. By making shaft 26 relatively small, thus reducing thrust and moment of inertia of the moving parts, it is possible to use a radial bearing for bearing 33 instead of a thrust bearing, despite the high pressures of the fluid conducted through the rotating mechanism. This is a particular advantage because thrust bearings generally require external sealing and lubrication, which would complicate the design of the rotating mechanism and make it more difficult to make it compact and substantially maintenance free.

With this construction, shaft 26 may be rotated within rotator 22 while the housing remains stationary and fluid may be conducted through interior chamber 27 of shaft 26 while it is being rotated. If desired, a vent opening 37 may be provided in rotator 22 to permit any fluid that leaks into the interior of rotator 22 to be discharged.

The end of shaft 26 opposite neck portion 28, and extending from inner portion 31, includes a plurality of threads 38 which extend from the interior of gear housing 21 through a front wall **21*a* of the gear housing. A relatively large gear 39 may be mounted on shaft 27 by threads 38 and gear 39 may be driven or rotated by a smaller gear 40 connected to an output shaft 41 of air motor 20. Thus, as air motor 20 is rotated, rotating shaft 41 and gear 40, gear 39 is in turn rotated to rotate shaft 26. Also, threads 38 may further the utilized to connect lance 17 to shaft 26 so that lance 17, which includes an interior passageway 43 through it, may be rotated by shaft 26 with passageway 43 in line and in fluid communication with passageway 27 of shaft 26**.

Throughout the description of the other figures of the drawings, reference to rotating mechanism R will refer to the rotating mechanism described in FIG. 3 or its equivalent to provide connection between a stationary high pressure fluid source, such as dump gun 13 or a dump valve, and a rotatable cleaning apparatus such as lance 17 described.

Figure 4:
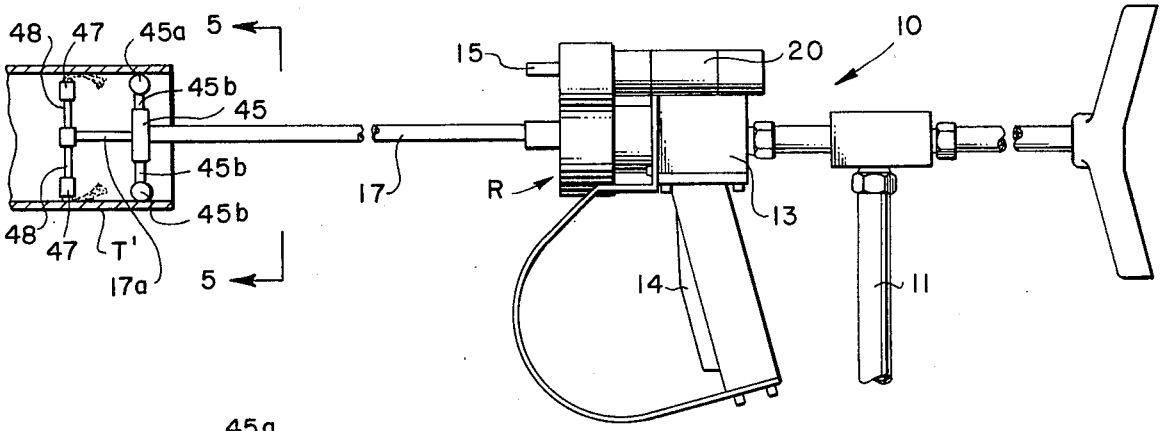
FIG. 4 is a side view in elevation of another form of the high pressure fluid delivery system of this invention in which a spray head having a plurality of nozzles is rotatably connected to a dump gun.
Figure 5:
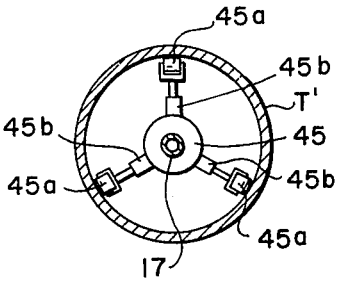
FIG. 5 is a sectional view taken at 5 – 5 in FIG. 4.

In FIG. 4, the fluid delivery system of this invention described may be utilized to clean the interior of a relatively larger diameter tube T' than that illustrated in FIG. 1. In FIG. 4, lance 17 is connected to a trolley 45 which includes three wheels 45*a* mounted 120° apart on extendable arms 45*b* as illustrated in FIG. 5. Rotatable cleaning head 46 is connected to trolley 45 and to rotating lance 17 through a tubular lance extension 17*a*, and cleaning head 46 includes, in the example illustrated, two cleaning or spray nozzles 47 mounted by a tubular arm extension 48 close to the interior wall of a tubular member T'. Arm extension 48 is perpendicularly mounted on lance extension 17*a*, and fluid communication is provided from passageway 43 of lance 17, through lance extension 17*a*, arm extension 48 and nozzles 47. Thus, as cleaning head 46 is rotated within the interior of tubular member T' and trolley 45 is pushed along the length of the tubular member, a jet of cleaning fluid may be applied along the interior wall of tubular member T'.

Figure 6:
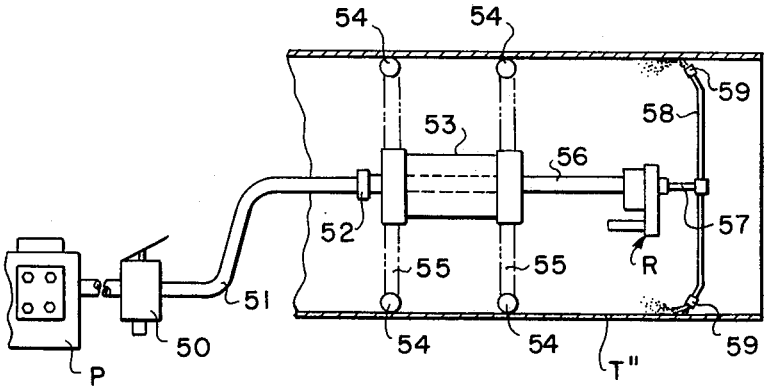
FIG. 6 is a view in elevation of another form of the high pressure fluid delivery system of this invention in which a spray head having a plurality of nozzles is rotated to clean the inside of a relatively large diameter tubular member.

Referring now to FIG. 6, an embodiment of the present invention is illustrated for cleaning the inside wall of a relatively large tubular member T'', such as the suction roll in a paper mill. For this purpose, the high pressure output of a pump P is connected to a dump valve 50 and the outlet of the dump valve is connected through a flexible hose 51 to an inlet coupling 52 of a trolley or traveling carriage 53. Carriage 53, which has the same general configuration from the back or front as carriage 45 illustrated in FIG. 5, includes two spaced apart sets of wheels 54 mounted on arm extensions 55 (which, if desired, may be adjustable in length to permit use of the carriage in different size tubular members) and the arm extensions are located at the 120° positions as illustrated in FIG. 5. Thus, carriage 53 is self supporting and may roll on wheels 54 back and forth along the length of tubular member T'', depending upon the length of flexible hose 51.

Also, fluid is fed through carriage 53 by a conduit 56 to which inlet 52 is connected on one side thereof and which extends from the other side of the carriage and supports rotating mechanism R as illustrated in FIG. 6. rotating mechanism R includes an output shaft 57 and a cleaning head 58 is mounted perpendicular thereto, and in fluid communication therewith, for rotation about the interior of tubular member T''. The fluid is conducted through output shaft 57 and cleaning head 58, which is an elongated tubular member, to nozzles 59, located at each end of cleaning head 58, to provide a cleaning jet of fluid under high pressure. As illustrated in FIG. 6, it is preferred that the end portions of cleaning head 58 be angled so that the nozzles 59 direct the fluid at a slight acute angle, towards carriage 53, against the interior surface of tubular member T'' so that carriage 53 is caused to "walk" along the length of the tubular member in response to the force of the pressure directed against the interior wall of the tubular member.

Figure 7:
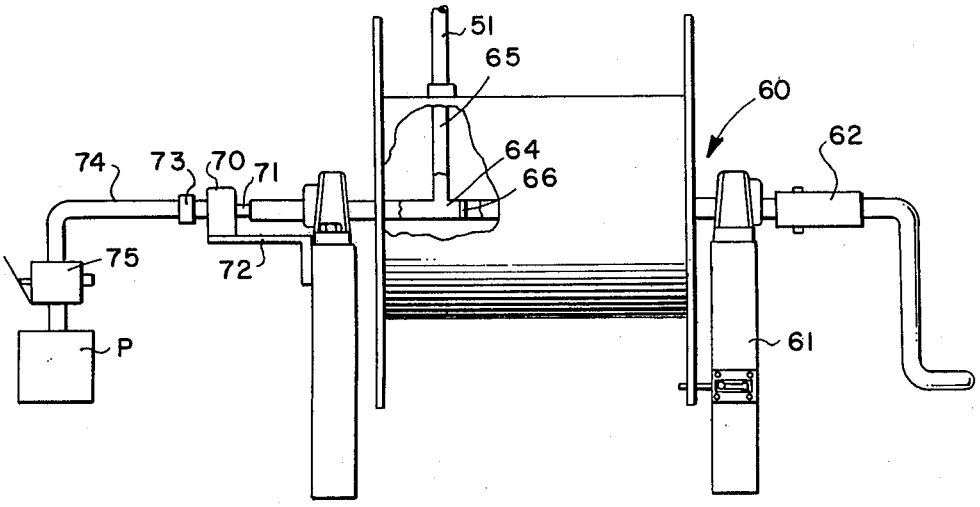
FIG. 7 is a view in elevation of another form of the high pressure fluid delivery system of this invention in which a cable reel is rotatably connected to a source of high pressure fluid.

Referring now to FIG. 7, an embodiment of the fluid delivery system of the present invention is illustrated in which a flexible hose, such as flexible hose 51 in the FIG. 6 embodiment described, can be reeled out from a cable reel connected to a stationary source of high pressure fluid by use of the rotating mechanism of this invention connected between the cable reel and the stationary source of fluid pressure. Thus, in FIG. 7, a drum type cable reel 60 is rotatably mounted on a stand or frame 61 and may be rotated manually by a handle 62 or by a motor (not shown) connected thereto. Cable reel 60 is mounted on stand 61 by a center tubular shaft 64 to which a conduit 65 is connected for connection to an end of hose 51. conduit 65 is tubular and is connected so that its internal passageway is fluid communication with the internal passageway of shaft 64, and a plug 66 may be provided in shaft 64, or at the end thereof to which handle 62 is connected, to prevent the passage of fluid out of shaft 64.

As illustrated in FIG. 7, a rotator 70, which preferably is the same in detail as the rotator described with respect to FIG. 3, is connected through its rotatable output shaft 71 to an end of rotatable shaft 64 and rotator 70 is mounted by a bracket 72 on frame 61. Rotator 70 includes an inlet coupling 73 which is connected to a pipe or conduit 74 which is in turn connected to a dump valve 75 which receives high pressure cleaning fluid, such as water, from a pump P. Thus, while reel 60 is rotated to payout hose 51, for example as trolley 53 in the FIG. 6 embodiment is moved along the length of tubular member T'', fluid may be conducted at high pressure from stationary pipe 74 through rotator 70 to rotating shaft 64 and thus to flexible hose 51.

Figure 8:
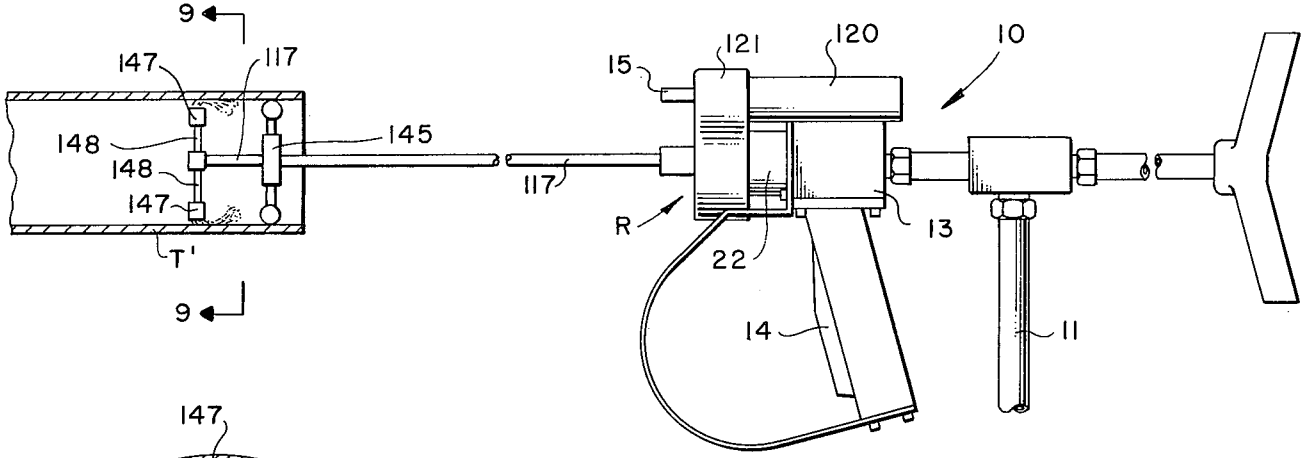
FIG. 8 is a side view in elevation of another form of this invention.
Figure 9:
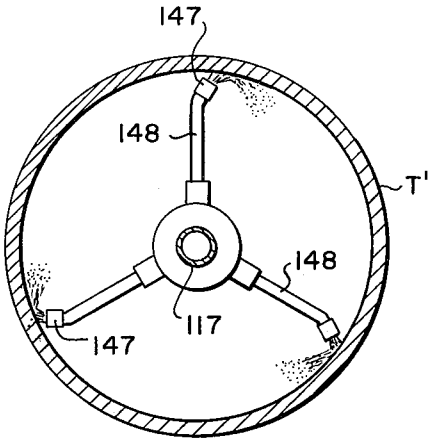
FIG. 9 is a sectional view taken at 9 — 9 in FIG. 8.

Referring now to FIGS. 8 and 9, an alternate form of this invention is illustrated in which air motor 20 of the previous figures is replaced by a centrifugal brake 120 which is connected through a gear assembly (not shown) in a gear housing 121 to a rotating mechanism 22 rotatably connected to a rotating tubular lance 117. Lance 117 includes a rotatable cleaning head having three outlet nozzles 147 mounted on arm extensions 148 and rotated by lance 117. The ends of arms 148 on which nozzles 147 are mounted are angled as illustrated in FIG. 9 so that the cleaning head and lance 117 (which is supported in a tubular member T' by a carriage 145) are rotated by the force of the fluid jet from nozzles 117. Since with this arrangement it is possible to achieve higher rotational speeds of the cleaning head than necessary for cleaning purposes, and higher than the bearing in rotating mechanism can tolerate for a reasonable period of time, centrifugal brake 120 functions to keep this rotational speed within practical limits as it will be actuated when this speed exceeds a predetermined r.p.m.

Other than as described, the apparatus illustrated in FIGS. 8 and 9 is identical to that illustrated in FIGS. 4 and 5.

Of course, the various embodiments described of the fluid delivery system of the present invention may take a number of different forms so long as a relatively high pressure cleaning fluid, i.e., at pressures of 6,000 p.s.i. to 10,000 p.s.i. and greater, is conducted from a stationary source of such fluid through a valve control mechanism, to a rotating cleaning mechanism, having at least one nozzle outlet, such as the rotating elongated lance or rotating cleaning head described in the foregoing detailed description of the drawings.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A fluid delivery system for delivering fluid at a relatively high pressure from a fluid source to an object to be cleaned, comprising, in combination:

a high pressure pump including in inlet adapted to be connected to said fluid source, and an outlet;

dump valve means including an inlet connected to said outlet of said pump, a relatively high pressure fluid outlet, a relatively low pressure dump outlet, and means for directing fluid from said inlet between said high pressure fluid outlet and said dump outlet;

a cleaning mechanism including at least one outlet nozzle for directing cleaning fluid against the object to be cleaned; and a rotating mechanism connected between said high pressure fluid outlet and said cleaning mechanism for permitting rotation of said cleaning mechanism while conducting said relatively high pressure fluid from said dump valve means to said outlet, said rotating mechanism including a rotator having a stationary housing with a fluid inlet, a rotatable shaft having an internal fluid passageway extending from said inlet and through the housing, said shaft including an elongated neck portion of relatively small diameter extending into said fluid inlet, and a large diameter main body portion, bearing means disposed in said housing to rotatably mount said shaft in said housing, and seal means between the neck portion of said shaft and said housing to prevent the passage of high pressure into said housing, said rotating mechanism further including a motor for rotating said rotatable shaft and means for connecting said motor to the shaft for rotation thereof.

2. The system of claim 1 wherein said cleaning mechanism includes an elongated lance for insertion into and along the length of a tubular member, said lance being connected to said high pressure fluid outlet and including an internal fluid passageway in fluid communication at one end of said lance with said outlet, and a nozzle on the other end of said lance including at least two openings in fluid communication with said fluid passageway.

3. The system of claim 1 wherein said last mentioned means is a gear mechanism.

4. The system of claim 1 wherein said cleaning mechanism includes a rotatable cleaning head having a plurality of outlet nozzles thereon, and further including a carriage for rotatably supporting said cleaning head inside a tubular member, and for movement along the length of said tubular member.

5. The system of claim 1 wherein said cleaning mechanism an elongated lance connected to said high pressure fluid outlet and including an internal fluid passageway in fluid communication at one end of said lance with said outlet, a carriage connected to said lance adjacent the other end thereof for supporting said lance for movement along the length of a tubular member to be cleaned, and a rotatable cleaning head having a plurality of nozzle outlets and being connected to said other end of said lance and substantially perpendicular thereto, to provide fluid communication between the interior of said lance and said nozzles, whereby rotation of said lance by said rotating mechanism causes rotation of said cleaning head about the interior of said tubular member as said carriage is moved along the length of the tubular member.

6. The system of claim 2 wherein said dump valve means is a dump gun, said rotating mechanism is mounted on said dump gun, and said lance is connected to said rotating mechanism to form an integral cleaning unit.

7. The system of claim 5 wherein said dump valve means is a dump gun, said rotating mechanism is mounted on said dump gun, and said lance is connected to said rotating mechanism to form an integral cleaning unit.

8. The system of claim 1 further including a movable carriage for supporting and centering a rotatable shaft in a tubular member to be cleaned, and for permitting movement of said shaft along the length of said tubular member, a flexible hose interconnecting said dump valve means and said carriage, and wherein said cleaning mechanism is a rotatable cleaning head mounted for rotation by said rotatable shaft and having a plurality of nozzle outlets adapted to be supported adjacent the interior surface of said tubular member, and said rotating mechanism is mounted on said carriage to provide for rotation of said rotatable shaft while conducting high pressure cleaning fluid from said flexible hose to said cleaning head where it is discharged from said nozzles during rotation of said cleaning head, and during movement of said carriage along the length of said tubular member.

9. The system of claim 8 further including a hose reel upon which said flexible hose may be wound, said hose reel including a rotatable shaft including an interior fluid passageway and means for connecting said flexible hose to said fluid passageway for the conduction of fluid, and a rotator connected between the rotatable shaft of said cable reel and the high pressure outlet of said dump valve means for permitting rotation of said shaft while high pressure cleaning fluid is conducted from said dump valve means to said flexible hose.

10. The system of claim 4 wherein said outlet nozzles are oriented to direct a fluid therefrom in a manner to at least partially propel said carriage along said tubular member.

11. The system of claim 8 wherein said outlet nozzles are oriented to direct a fluid therefrom in a manner to at least partially propel said carriage along said tubular member.

12. As a subcombination, a rotator for providing relative rotation between a non-rotating source of high pressure fluid and a rotating cleaning through which the high pressure fluid is to be conducted, comprising a stationary housing having a fluid inlet, rotatable shaft having an internal fluid passageway extending from said inlet and through the housing, said shaft including an elongated neck portion of relatively small diameter extending into said inlet and a main body portion of relatively larger diameter extending from said neck portion into the interior of said housing, bearing means disposed in said housing to rotatably mount said shaft in said housing, and high pressure, low friction seal means between said shaft and said housing to prevent the passage of high pressure fluid into said housing, said rotator being an integral part of a rotating mechanism for rotating said cleaning mechanism, and said rotating mechanism further including a motor for rotating said rotatable cleaning mechanism and connecting means for connecting said motor to the shaft for rotation thereof, said rotator, motor, and connecting means being mounted together to form an integral unit.

13. The system of claim 12 wherein said rotator is an integral part of a rotating mechanism for rotating said cleaning mechanism, and said rotating mechanism further includes a motor for rotating said rotatable cleaning mechanism and connecting means for connecting said motor to the shaft for rotation thereof, said rotator, motor, and connecting means being mounted together to form an integral unit.

14. The fluid delivery system of claim 1 wherein said rotating mechanism includes braking means for retarding the rotation of said cleaning head when said rotation exceeds a predetermined speed.

15. A fluid delivery system for delivering fluid at a relatively high pressure from a fluid source to an object to be cleaned, comprising, in combination:

a high pressure pump including an inlet adapted to be connected to said fluid source, and an outlet;

dump valve means including an inlet connected to said outlet of said pump, a relatively high pressure fluid outlet, relatively low pressure dump outlet, and means for directing fluid from said inlet between said high pressure fluid outlet and said dump outlet;

a cleaning mechanism including at least one outlet nozzle for directing cleaning fluid against the object to be cleaned; and a rotatinng mechanism connected between said high pressure fluid outlet and said cleaning mechanism for permitting rotation of said cleaning mechanism while conducting said relatively high pressure fluid from said dump valve means to said outlet, said rotating mechanism including a rotator having an internal fluid passageway extending from said inlet and through the housing, bearing means disposed in said housing to rotatably mount said shaft in said housing, and seal means between said shaft and said housing to prevent the passage of high pressure fluid into said housing, said rotating mechanism further including a motor for rotating said rotatable shaft and means for connecting said motor to the shaft for rotation thereof, said rotating mechanism including only a relatively small portion of its internal surface area exposed to said high pressure in a way to oppose rotation of said shaft.

* * * * *

UNITED STATES PATENT AND TRADEMARK OFFICE

CERTIFICATE OF CORRECTION

PATENT NO. : 3,987,963

DATED : October 26, 1976

INVENTOR(S) : Amos Pacht

It is certified that error appears in the above-identified patent and that said Letters Patent are hereby corrected as shown below:

Column 4, line 21, "portions" should be -- portion -- .
Column 4, line 22, "26" should be -- 36 -- .
Column 4, line 31, "by" should be -- be -- .
Column 5, line 46, "rotating" should be -- Rotating -- .
Column 6, line 7, "conduit" should be -- Conduit -- .
Column 6, line 8, after "is" insert -- in -- .
Column 7, line 61, after "mechanism" insert -- includes -- .
Column 8, line 55, after "cleaning" insert -- mechanism -- .

Signed and Sealed this

Twenty-second Day of February 1977

[SEAL]

*Attest:*

RUTH C. MASON
*Attesting Officer*

C. MARSHALL DANN
*Commissioner of Patents and Trademarks*